US005226367A

United States Patent [19]

McLaughlin

[11] Patent Number: 5,226,367

[45] Date of Patent: Jul. 13, 1993

[54] APPARATUS FOR DRIVE ON LOADING OF A RAILWAY CAR

[76] Inventor: Eric R. McLaughlin, 2642 Game Farm Rd., Springfield, Oreg. 97477

[21] Appl. No.: 930,795

[22] Filed: Aug. 17, 1992

[51] Int. Cl.[5] ..... B61B 1/00

[52] U.S. Cl. ..... 104/29; 104/30; 104/243; 105/215.1; 105/216; 105/217; 105/458

[58] Field of Search ..... 104/29, 27, 30, 243, 104/306; 105/215.1, 216, 217, 211, 355, 363, 370, 393, 458, 462; 410/56

[56] References Cited

U.S. PATENT DOCUMENTS

| | | | |
|---|---|---|---|
| 194,899 | 9/1877 | Eckman | 104/243 |
| 252,918 | 1/1882 | Wilson . | |
| 304,054 | 8/1884 | Whiley | 105/215.1 |
| 388,743 | 8/1888 | Thompson | 104/243 |
| 4,190,393 | 2/1980 | Landow | 104/29 |
| 4,425,064 | 1/1984 | Walda et al. | 105/217 |
| 4,964,767 | 10/1990 | Leitz | 410/65 |

FOREIGN PATENT DOCUMENTS

| | | | |
|---|---|---|---|
| 3425698 | 1/1986 | Fed. Rep. of Germany . | |
| 0764055 | 5/1934 | France | 105/458 |
| 2430376 | 3/1980 | France | 104/29 |
| 0081767 | 3/1990 | Japan | 105/458 |
| 0016872 | 1/1991 | Japan | 105/458 |
| 9107301 | 5/1991 | World Int. Prop. O. | 104/29 |

*Primary Examiner*—Mark T. Le
*Attorney, Agent, or Firm*—James D. Givnan, Jr.

[57] ABSTRACT

A railway loading dock is provided with adjacent trackage having pairs of main rails and stabilizing rails. A modified railway flatbed car is equipped along its sides with stabilizing wheels and associated support structure to retain the car bed coplanar with the loading dock surface to permit drive on loading and drive off unloading of large trucks. The railway car bed is equipped with bed extensions which primarily occupy that space between ends of adjacent cars to permit travel of trucks, in a straight or oblique manner, over the ends of adjacent railway cars. The stabilizing rails have inclined segments for gradual engagement with the car stabilizing wheels.

9 Claims, 3 Drawing Sheets

APPARATUS FOR DRIVE ON LOADING OF A RAILWAY CAR

BACKGROUND OF THE INVENTION

The present invention pertains generally to a system and equipment enabling the drive on loading and drive off unloading of trucks from a flat bed railway car.

Well known is the practice of transporting truck trailers by loading same onto specially modified railway cars. Such transport of trailers is termed piggyback in the trade. An important drawback to the shipping of truck trailers by piggyback is the man hour effort in the loading and off loading of the trailers and the support equipment required to accomplish same.

German patent application DE 3425698A1 published Jan. 23, 1986, discloses a truck tractor and trailer equipped with auxiliary undercarriages for lateral travel of both the truck tractor and attached trailer during loading onto a railway car equipped with a side mounted ramp. Accordingly it has been proposed to ship both truck tractor and trailer as a unit on a railway car.

U.S. Pat. No. 4,964,767 discloses the stabilizing of a stationary flat bed railway car by car components extensibily engageable with the edge structure of a loading dock to prevent lateral tipping of the car during loading of a truck trailer. The truck tractor is used as a prime mover during such loading and unloading. Various car stabilizing means are disclosed to prevent lateral tipping as the trailer is moved on an auxiliary undercarriage laterally onto the railway car.

U.S. Pat. No. 252,918 is of some interest in that it discloses a railway car truck modified by the addition of glides at the four corners of a car truck. Each glide includes a wheel biased downwardly by a spring to engage a rail located outwardly from a conventional pair of rails. Car weight is, during travel, jointly carried by the wheels of the car truck and by the glides apparently to minimize sound. No loading-unloading purposes are disclosed. The glide carried wheels are carried on the car trucks and could not directly support the car frame against tipping during loading of the car from the side.

Regardless of the readily apparent advantages to the public of transporting truck tractors and their trailers as a unit via rail to distant destinations, no present system is in place or equipment presently available for accomplishing same.

SUMMARY OF THE PRESENT INVENTION

The present invention is embodied in railway car construction and trackage permitting drive on and drive off loading and unloading of trucks.

A railway car is disclosed having stabilizing means which, in conjunction with trackage, supports the car against deflection during loading and unloading. Car bed height is maintained regardless of loading coplanar with a loading dock surface as are car bed extensions which, when lowered into place, contribute to an uninterrupted surface area on which truck tractors and their trailers may be maneuvered into place on or off the railway car. Accordingly special loading equipment and costly modification of truck undercarriages are avoided.

A frame of the railway car is equipped with the stabilizing means which includes auxiliary or stabilizing wheels located outboard of the main car wheels for engagement with a second set of tracks provided at loading dock sites. The lateral clearance between the loading docks and the car bed is minimized to permit dispensing with ramps and the like. During loading or unloading operations, car bed extensions at the car ends are deployed to provide virtually an uninterrupted surface between the consecutive cars to the extent trucks and trailers may be maneuvered thereon in an unrestricted manner.

The trackage provided for support of the stabilizing wheels extends beyond the loading dock for the purpose of effecting wheel engagement in a gradual manner. Similarly loading dock entrances are provided with rub strips to ensure guiding of the car bed into close proximity to the dock edge or edges. As the bed of the railway car is supported against loads imparted during side or end loading of the cars, contact of the car with the dock is avoided to permit dispensing with costly modification of loading dock structure. Since the railway car frame is prevented from lateral tipping motion and downward displacement, truck passage onto and off of a railway car may be in an oblique direction to permit driving on of the truck tractor and trailer without reliance on special loading equipment.

Important objectives of the present invention include the provision of a railway car equipped with stabilizing means to ensure the car bed is at all times substantially coplanar with the surface of the loading dock; the provision of a railway car equipped with car bed extensions positionable to provide a virtually continuous surface between consecutive railway cars and loading dock surfaces on opposite sides of the car; the provision of loading dock structure providing a dock edge in close proximity to the bed of a railway car with dock structure adapted for guidance of the car during entry into the dock area; the provision of trackage for the support of car stabilizing wheels carried by the car.

DETAILED DESCRIPTION OF THE PREFERRED EMBODIMENTS

Figures 1, 2, 3:
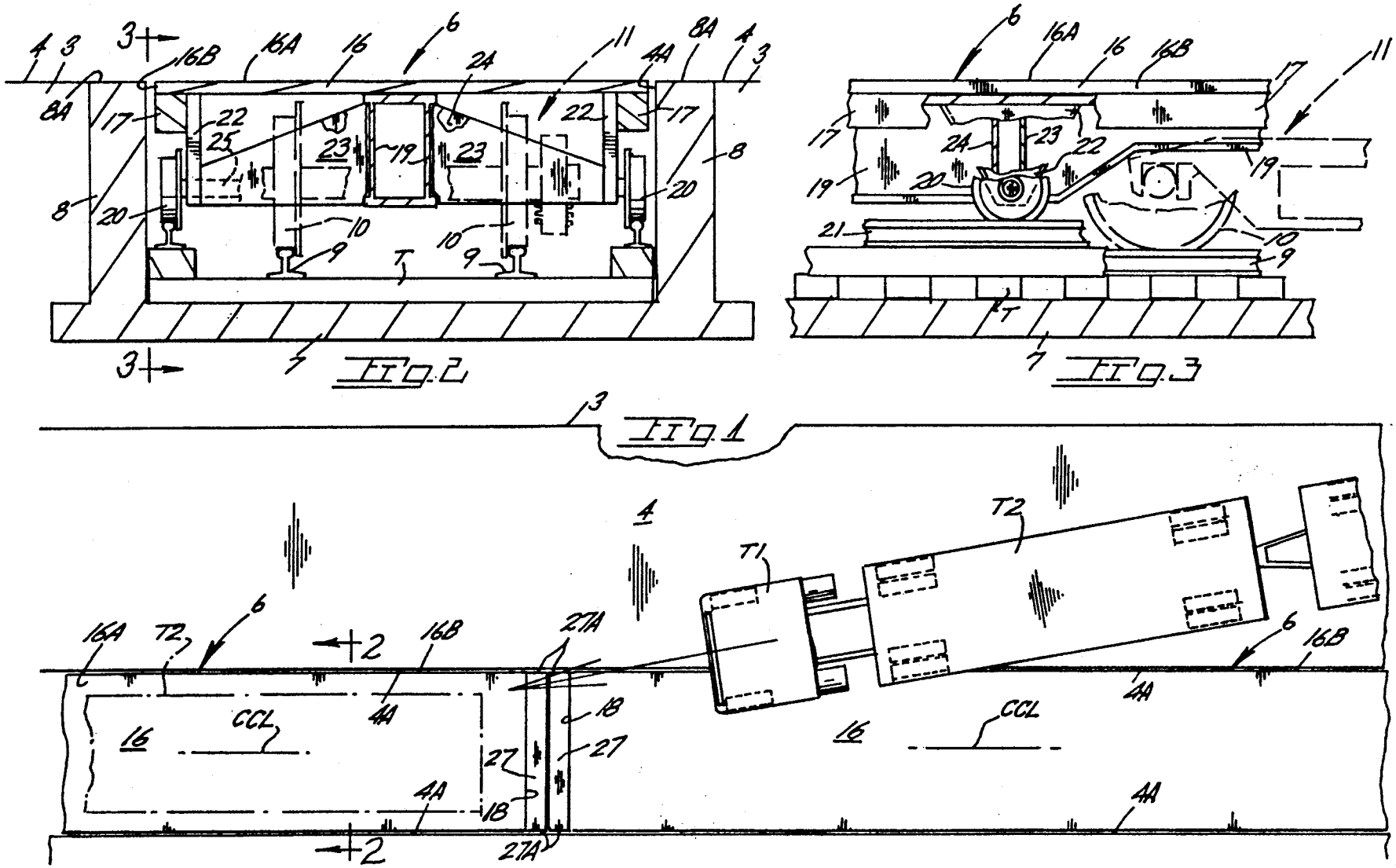
FIG. 1 is a plan view of a loading dock with flat bed railway cars adjacent thereto and a truck and trailer being driven into place on the car.
FIG. 2 is a vertical sectional view taken along line 2—2 of FIG. 1 and showing details of stabilizing means of the car.
FIG. 3 is a side elevational view taken along line 3—3 of FIG. 2.
Figure 4:
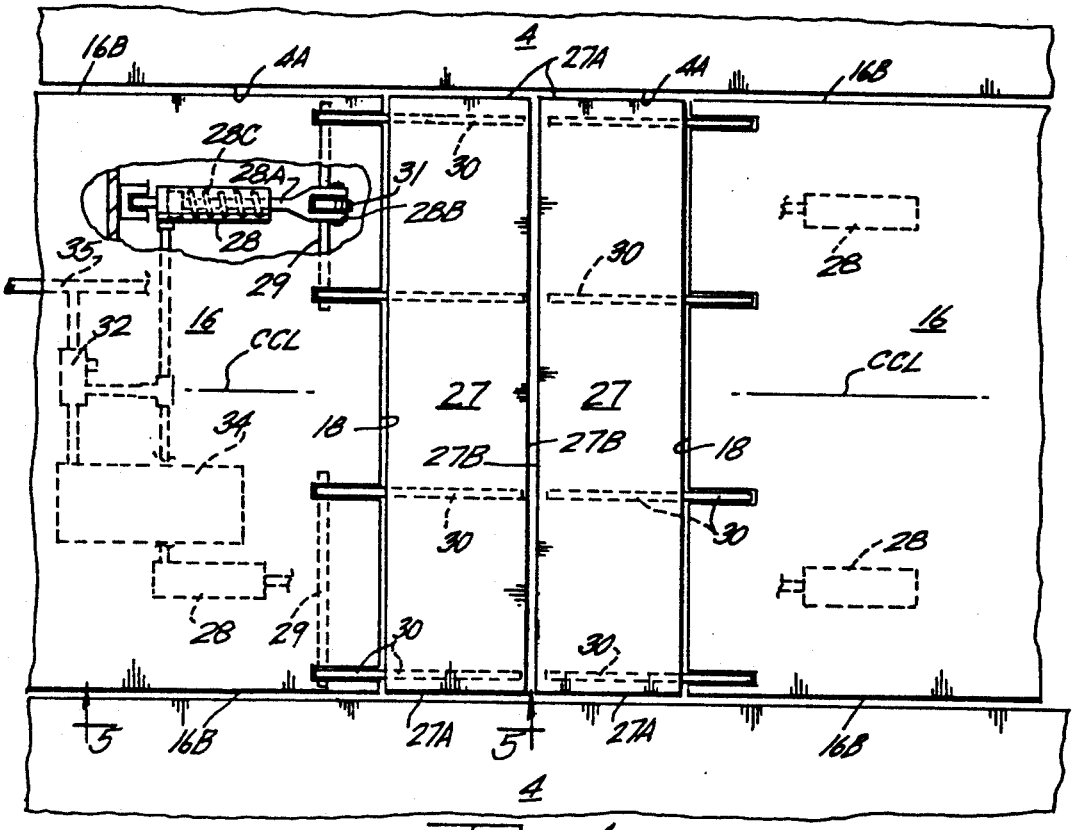
FIG. 4 is a fragmentary plan view of car bed extensions carried by coupled railway cars.
Figure 5:
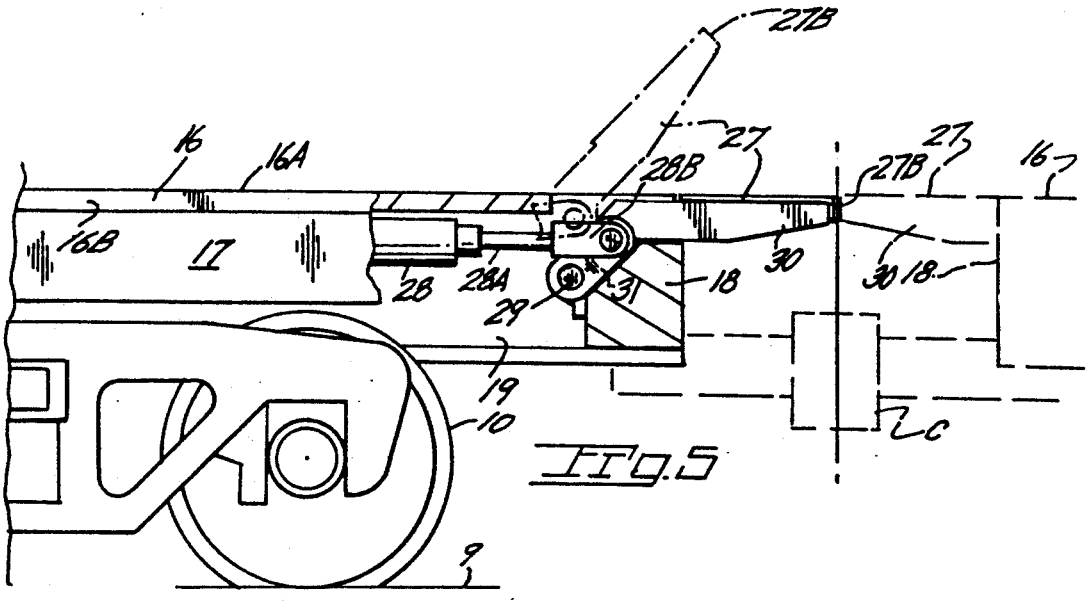
FIG. 5 is a side elevational view of the car and car bed extensions taken along line 5—5 of FIG. 4.

With continuing attention to the drawings wherein applied reference numerals indicate parts hereinafter similarly identified, the reference numeral T1 indicates the tractor of a truck including a semitrailer at T2. Such trucks are of the type commonly used for the interstate highway transport of goods.

With reference to FIG. 1 and FIG. 2 a loading dock at 3 has a vehicle traversable surface 4. A ramp at 5 (FIG. 7) provides vehicle access to loading dock surface 4. Preferably the loading dock includes structures oppositely disposed from the following described trackage to provide vehicle access to the sides of a modified flatbed railway car, generally at 6, from both dock surfaces 4. Dock edges are at 4A.

A foundation for the later described trackage includes a base 7 with walls 8 the upper surface 8A of which is a continuation of dock surface 4. Rails at 9 and ties T on the foundation support the wheels 10 of a railroad car truck assembly indicated generally at 11 in FIGS. 2 and 3. Indicated at 16 is a load receiving bed of the car with a bed surface 16A. A car frame is at 17 and extends along the car sides below the sides 16B of the car bed. The frame is rectangular with frame ends members at 18.

Auxiliary or stabilizing wheels at 20 are located below the car sides for travel along stabilizing rails 21 each oppositely offset from the main track rails 9. The stabilizing wheels 20 are part of car stabilizing means located adjacent each of the truck assemblies 11 and which also include a welded plate structure secured to and extending crosswise of the underside of the car and secured to the side of the car frame at 17. The structures include end uprights at 22 terminating upwardly at the car frame 17. Reinforcing the end mounted uprights 22 are plates 23 and 24 which also serve to house axles 25 for stabilizing wheels 20. The upright plates 23 and 24 of each stabilizing wheel support structure terminate at and are secured to the longitudinally extending central frame component 19 of the flatbed car having a centerline at CCL. From the foregoing it will be seen that when the stabilizer wheels 20 are rail supported at a dock site, the bed of the railway car is supported against deflection by loads such as trucks being driven onto or off of the car in oblique directions. The close proximity of the car edge to the dock edge 4A dispenses with any ramp requirement. Typically a modified flat car would include at least four stabilizing wheels one each near a car truck.

At the car end are mounted bed extensions 27 each positionable as later described between horizontal and inclined positions. The bed extensions and those of adjacent cars, when horizontal, jointly occupy that area intermediate the ends 18 of the car frames to provide coplanar surfaces across which vehicles may travel in various directions during loading and unloading maneuvering. The extensions are of a lengthwise dimension approximating car width to locate bed extension ends at 27A proximate the loading dock edges 4A similar to the proximate relationship of the car sides to the dock edges. When jointly lowered into their operative or horizontal positions the combined bed extensions serve to provide a continuous traversable surface for the vehicle being loaded or unloaded. Bed extension distal edges 27B lie, when lowered, in a vertical plane containing the midpoint between cars coupled at C. Actuating cylinders 28, carried subjacent the car bed, preferably include internal springs 28C which serve to bias the cylinder piston rod at 28A and clevis 28B to a retracted position in the absence of air to raise bed extension arms at 30 by a crank 31 and shaft 29 to an elevated or travel position about shaft 29 providing necessary clearance between railway car ends. A pressurized air tank source at 34 is in communication with the blind end of the cylinders to activate the cylinders for rod extension for lowering of the extensions to the operable, horizontal position. A valve at 32 is preferably air operated and hence is in communication with the car air system 35 and the train air system by suitable air conduits and fittings to permit valve actuation from a remote location.

Figures 6, 7:
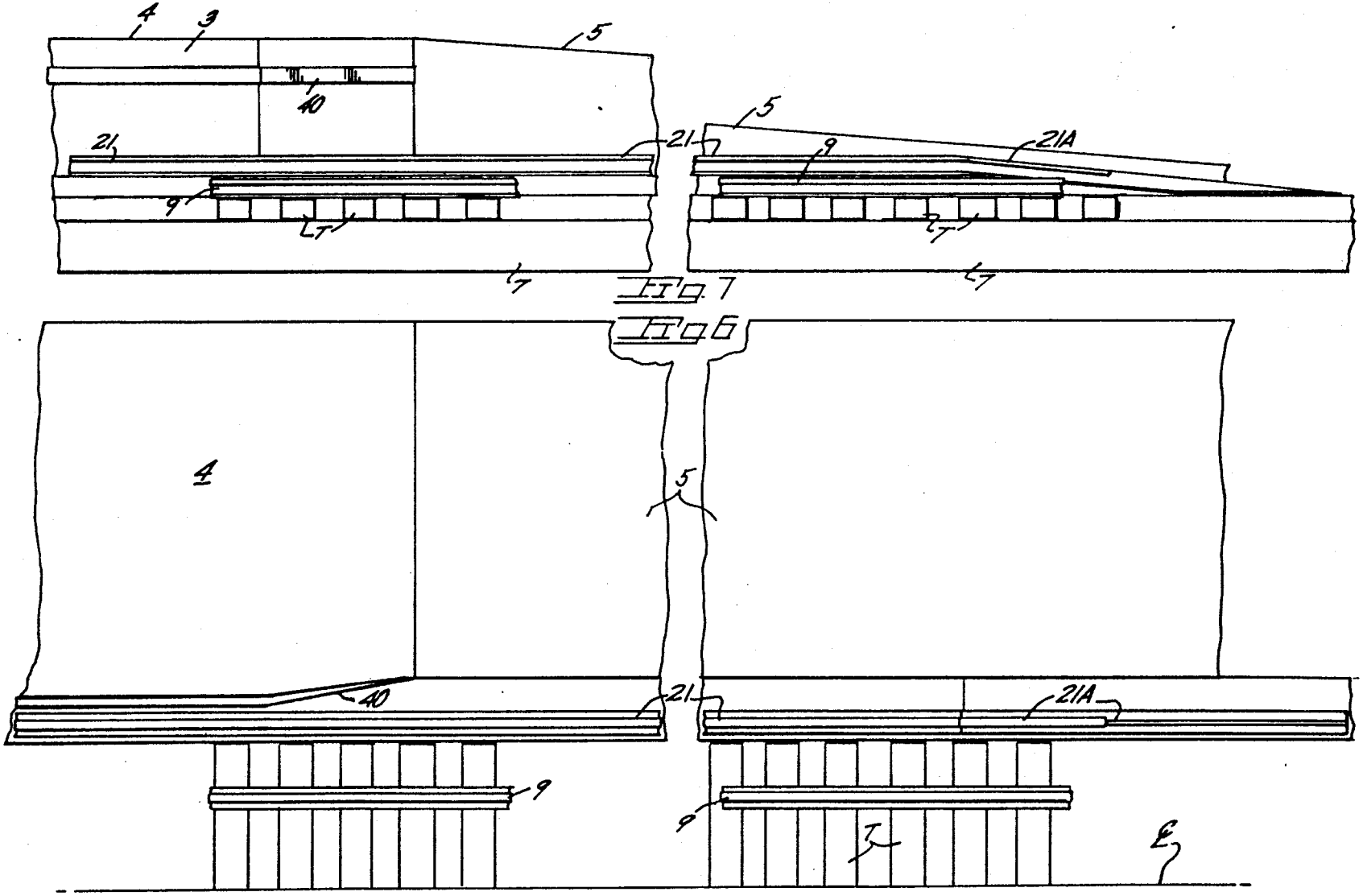
FIG. 6 is a fragmentary plan view of a segmented loading dock and associated trackage.
FIG. 7 is an elevational view of the loading dock and trackage shown in FIG. 6 and taken along the centerline of FIG. 6.

FIG. 6 and FIG. 7 of the drawing disclose trackage for the present railway car equipped with stabilizing wheels and also loading dock construction contributing to the present drive on and drive off car loading system. The stabilizing rails 21 each terminate at least at one of their ends in sloped segment 21A to permit gradual engagement and disengagement with stabilizing wheels 20. During such engagement, the sprung weight of the car is gradually transferred to the stabilizing rails while the car truck wheels 10 maintain engagement with the main rails 9. In the event for some reason the railway car is not in precise position relative a loading dock or docks, rub strips as at 40 on a dock end will align the car. While only one portion of the trackage adjacent one end of the loading dock is shown it is to be understood that if the loading dock is of the open ended type the remaining trackage associated with the unseen end of same will also be provided with inclined rail segments 21A to permit gradual transfer of car sprung weight and the load thereon onto the conventional trucks of the car.

The present apparatus permits trucks to be driven directly onto the loading docks and then onto a railway car 6 all in continuous fashion and at a great savings of man hours and capital expense in costly support eqiupment. Tie down equipment would be of the known type used for securing loads to a railway car e.g., chains and binders. Depending on various factors affecting cost of operation, a train comprised of flat bed cars of the above described type may include passenger railway cars for the truck operators to permit the same operator to remain with the truck at the destination.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A drive on and drive off system for railway cars and comprising in combination, a railway loading dock having at least one vehicle traversable surface terminating in a dock edge, trackage adjacent said edge and including a first pair of rails on which a railway car may travel, a second pair of rails with each rail of said second pair of rails oppositely offset outwardly from said first pair of rails, and a railway car having a frame including side and end members and a bed surface coplanar with said vehicle traversable surface of the dock, trucks supporting said car on said first pair of rails, car stabilizing means on said car subjacent and integral with the frame side members, each of said means including wheel means for engagement with a rail of said second pair of rails for supporting the car against downward movement during the passage of vehicles from said vehicle traversable surface of the dock to the bed surface of the car, said bed having sides offset from the centerline of the car a distance so as to be proximate the dock edge to permit vehicle passage directly onto and off of said bed surface of the railway car, a bed extension adjacent each end of said car frame, means swingably coupling said extension to the car frame and permitting movement of the bed extension about a horizontal axis to a position coplanar with the bed surface.

2. The system claimed in claim 1 including powered means for positioning said bed extension about the horizontal axis, said bed extension positionable to an inclined position to provide clearance from an adjacent railway car.

3. The drive on and drive off system claimed in claim 1 wherein said car stabilizing means includes welded plate structures secured transversely of the car frame, each of said structures including a pair of stabilizing wheels for engagement with said second pair of rails.

4. The drive on and drive off system claimed in claim 3 wherein said each of said plate structures is integral with the frame of said car.

5. The drive on and drive off system claimed in claim 2 wherein the bed extension at each end of the car frame when coplanar with the car bed occupies a horizontal plane extending from a projection of the railway car centerline to the dock edge to supplement the traversable area of the car bed.

6. The drive on and drive off system claimed in claim 5 additionally including multiple railway cars coupled to one another and each equipped at its ends with said bed extensions, the bed extensions on adjacent cars substantially and jointly occupying a horizontal rectangular plane having two sides defined by the ends of the frames of said cars.

7. The drive on and drive off system claimed in claim 2 additionally including cylinders of a spring return type to spring bias the bed extension to an inclined position to contribute to horizontal clearance between coupled railway cars.

8. The drive on and drive off system for railway cars claimed in claim 1 wherein said car stabilizing means includes welded plate structures affixed to the car frame, each of said welded plate structures located proximate one of said trucks of the railway car, said second pair of rails and said wheel means when entrained thereon acting to stabilize the car frame with the surface of the car bed substantially coplanar with the traversable surface of the loading dock.

9. In a railway flatcar having a rectangularly shaped bed with a load receiving surface, a frame supporting the bed and trucks with wheels for engagement with railroad tracks, the improvement comprising, bed extensions one each swingably disposed on opposite ends of the bed, powered means coupled to said bed extensions and operable to position the bed extensions to horizontal and to inclined positions, each of said extensions of elongate shape and having ends disposed in substantial alignment with sides of the flatcar bed, said bed extensions each having a distal edge positionable proximate a vertical plane containing a midpoint located between two coupled cars, car stabilizing means having pairs of stabilizer wheels with the wheels of each of said pairs oppositely offset from the wheels of said trucks, said car stabilizing means additionally including plate structures affixed crosswise to said frame of the flatcar, axles carried by said plate structures for said stabilizer wheels.

* * * * *

UNITED STATES PATENT AND TRADEMARK OFFICE

CERTIFICATE OF CORRECTION

PATENT NO. : 5,226,367

DATED : July 13, 1993

INVENTOR(S) : Eric L. Mc Laughlin

It is certified that error appears in the above-indentified patent and that said Letters Patent is hereby corrected as shown below:

On the title page, Item [76]: Inventor should read as follows:
—Eric L. McLaughlin—

Signed and Sealed this

Twenty-third Day of November, 1993

Bruce Lehman

*Attest:*

BRUCE LEHMAN

*Attesting Officer*

*Commissioner of Patents and Trademarks*